US008580062B2

(12) United States Patent
Rodriguez

(10) Patent No.: US 8,580,062 B2
(45) Date of Patent: Nov. 12, 2013

(54) APPARATUS FOR APPLICATION OF A HOOK-AND-LOOP FASTENER COMPONENT TO A TURN-UP SYSTEM TEAR STRIP

(76) Inventor: Peter A. Rodriguez, Atlantic Beach, FL (US)

( * ) Notice: Subject to any disclaimer, the term of this patent is extended or adjusted under 35 U.S.C. 154(b) by 35 days.

(21) Appl. No.: 13/536,030

(22) Filed: Jun. 28, 2012

(65) Prior Publication Data

US 2013/0000850 A1 Jan. 3, 2013

Related U.S. Application Data

(60) Provisional application No. 61/571,436, filed on Jun. 28, 2011.

(51) Int. Cl.

| | |
|---|---|
| ***B29C 65/50*** | (2006.01) |
| ***B32B 37/00*** | (2006.01) |
| ***B32B 43/00*** | (2006.01) |
| ***B65H 7/04*** | (2006.01) |
| ***B31F 5/00*** | (2006.01) |

(52) U.S. Cl.

USPC ..... 156/235; 156/238; 156/246; 156/249; 156/289; 156/540; 156/541; 156/543; 156/555

(58) Field of Classification Search

USPC ..... 156/182, 184, 230, 235, 238, 239, 246, 156/247, 249, 289, 537–541, 543, 555

See application file for complete search history.

(56) References Cited

U.S. PATENT DOCUMENTS

| | | | | |
|---|---|---|---|---|
| 4,659,029 | A | 4/1987 | Rodriguez | |
| 4,757,950 | A | 7/1988 | Rodriguez | |
| 4,783,018 | A | 11/1988 | Rodriguez | |
| 5,417,383 | A | 5/1995 | Rodriguez et al. | |
| 5,725,177 | A | 3/1998 | Bartelmuss et al. | |
| 5,954,290 | A | 9/1999 | Rodriguez et al. | |
| 7,875,152 | B2 | 1/2011 | Rodriguez | |
| 8,220,388 | B2 * | 7/2012 | DeMoore et al. | 101/401.1 |
| 8,281,716 | B2 * | 10/2012 | DeMoore et al. | 101/401.1 |
| 8,347,466 | B2 * | 1/2013 | Baldauf et al. | 24/442 |
| 8,397,634 | B2 * | 3/2013 | DeMoore et al. | 101/401.1 |
| 8,424,453 | B2 * | 4/2013 | DeMoore | 101/217 |
| 2003/0125668 | A1 * | 7/2003 | Bierman | 604/174 |
| 2004/0135026 | A1 * | 7/2004 | Moore | 242/559.2 |
| 2007/0021284 | A1 * | 1/2007 | Onishi | 493/394 |
| 2010/0132412 | A1 * | 6/2010 | Baldauf et al. | 66/191 |
| 2010/0154665 | A1 * | 6/2010 | DeMoore et al. | 101/217 |
| 2010/0154667 | A1 * | 6/2010 | DeMoore et al. | 101/420 |
| 2010/0307357 | A1 * | 12/2010 | DeMoore | 101/420 |
| 2012/0048134 | A1 * | 3/2012 | DeMoore | 101/401.1 |
| 2012/0152138 | A1 * | 6/2012 | DeMoore et al. | 101/416.1 |
| 2012/0225764 | A1 * | 9/2012 | Ogasawara | 493/405 |
| 2012/0325100 | A1 * | 12/2012 | DeMoore et al. | 101/424.2 |
| 2013/0152810 | A1 * | 6/2013 | DeMoore et al. | 101/483 |

* cited by examiner

*Primary Examiner* — Sing P Chan
(74) *Attorney, Agent, or Firm* — Thomas C. Saitta

(57) ABSTRACT

An apparatus and method for securing a hook-and-loop fastener component to the end of a tear strip used in a turn-up operation, the hook-and-loop fastener mechanism provided to secure the end of the tear strip to a rotating component of a spool winding assembly, the apparatus for forming the tear strip assembly having a feed roller, a transfer roller and a press roller, whereby hook-and-loop components presented on a feed tape are adhesively bonded to the tear strip.

13 Claims, 3 Drawing Sheets

APPARATUS FOR APPLICATION OF A HOOK-AND-LOOP FASTENER COMPONENT TO A TURN-UP SYSTEM TEAR STRIP

This application claims the benefit of U.S. Provisional Patent Application Ser. No. 61/571,436, filed Jun. 28, 2011, the disclosure of which is incorporated herein by reference.

BACKGROUND OF THE INVENTION

This invention relates to an apparatus or machine for applying a hook-and-loop fastener component to the end of a tear strip, such as a paperband or similar strip used in the manufacture and handling of large rolls of paper sheet material. The hook-and-loop component comprises either the hook component or the loop component of a hook and loop fastener system, such a fastener often commonly referred to by the brand name VELCRO.

It is a common practice in the papermaking and packaging industries to employ a paperband, tape, strip, strap, band or similar member (the term "tear strip" being used as a general term hereinafter to encompass and refer to any such member regardless of the material of composition) that is loaded into the channel of a guide track assembly in a longitudinal direction and then pulled rapidly out of the channel in a direction generally perpendicular to the longitudinal direction. Such a tear strip is often employed to cut and retain a spooled web of paper on an axle, shaft or similar rotating member once the desired amount of paper web has been spooled. This is referred to as a turn-up operation or a cutting-and-spooling operation. In many known systems, the end of a length of tear strip is provided with an adhesive and advanced into a nip or similar mechanism operating in conjunction with the rotating spool whereby the end of the tear strip is adhesively secured to the rotating axle. The continued rotation of the axle then pulls the tear strip from the track assembly to cut and secure the roll of sheet or web material such that it will not unspool.

Turn-up systems and methods have been previously described in various patents, such as for example U.S. Pat. No. 4,659,029 to Rodriguez, U.S. Pat. No. 4,757,950 to Rodriguez, U.S. Pat. No. 4,783,018 to Rodriguez, U.S. Pat. No. 5,417,383 to Rodriguez et al., and U.S. Pat. No. 5,725,177 to Bartelmuss et al., the disclosures of which are incorporated herein by reference.

The use of adhesives in a turn-up system may create problems, since the adhesive's ability to adhere to the spool or axle may be diminished if the adhesive becomes coated with dust, lint or like contaminants which are often present in the spooling operation. Additionally, the application of the adhesive layer to the end of the tear strip can be problematical, as the equipment may require frequent maintenance due to the nature of the operation. To address this problem, it is known to utilize a hook-and-loop fastener component in place of the adhesive. One component of the hook-and-loop fastener is affixed to the free end of the tear strip, with the other component of the hook-and-loop fastener affixed to the rotating member of the turn-up spooling system. When the free end of the tear strip is advanced the hook-and-loop components mate and the tear strip is pulled from the slotted guide track. Such a system is disclosed in U.S. Pat. No. 5,954,290 to Rodriguez et al., the disclosure of which is incorporated herein by reference.

It is an object of this invention to provide an apparatus and method for securing a hook-and-loop component to the end of a tear strip used in a spooling and turn-up operation.

SUMMARY OF THE INVENTION

An apparatus and method for forming the tear strip member in a turn-up system is disclosed, with the turn-up system comprising a slotted guide track having a tear strip retained in a manner which allows the tear strip to be pulled from the slotted guide track in order to cut and secure a spooled paper web, the free or forward end of the tear strip comprising a first component of a hook-and-loop fastener, such as sold under the brand name VELCRO, the second and mating component of the hook-and-loop fastener being mounted onto the rotating member of the spool. Upon a desired length of paper web being wound onto the rotating member, the free end of the tear strip is advanced against the rotating member such that the first and second components of the hook-and-loop fastener mate, causing the tear strip to wind around the rotating member and be pulled from the slotted guide track, thereby cutting the moving paper web and securing the paper web roll against unspooling.

The apparatus and method comprise a fastener transfer press that transfers a hook-and-loop component, either the hook component or the loop component of a hook-and-loop fastener system, onto the end of a tear strip, the tear strip then being advanced through a track assembly such that the hook-and-loop component mounted onto the end of the tear strip is brought into contact with the opposite hook-and-loop component attached to a rotating component of the turn-up spool assembly, such that the two hook-and-loop components mate and cause the tear strip to be pulled from the track assembly onto the roll.

The hook-and-loop component is provided as a short segment having an adhesive backing layer, the adhesive layer temporarily retaining the hook-and-loop component on an elongated strip of release liner, the assembly defining a fastener feed tape. Multiple hook-and-loop components are positioned on the release liner. The fastener transfer press comprises three rollers—a feed roller, a fastener transfer roller and a reciprocating press roller. The feed roller and transfer roller are positioned such that the release liner and hook-and-loop component can be fed between the two rollers which together define a feed roller pair. The transfer roller is provided with a fastener transfer surface which is formed by the opposite hook-and-loop component to the hook-and-loop component disposed on the release liner. As the release liner passes between the feed roller pair, the hook-and-loop component temporarily mates with the fastener transfer surface and is separated from the release liner, thereby exposing the adhesive layer. The hook-and-loop component is then fed between the fastener transfer roller and the reciprocating press roller, which together define a press roller pair, such that the adhesive layer contacts the end portion of a tear strip which is situated between the press roller pair. The bond strength of the adhesive layer is chosen to be greater than the mechanical interlock strength of the hook-and-loop component on the transfer roller, such that the hook-and-loop component is released from the transfer surface and remains affixed to the end portion of the tear strip. The tear strip can now be advanced in known manner through a track assembly to perform the turn-up operation.

Preferably, the fastener transfer press is incorporated into the tear strip feed system of the turn-up system such that the application of the hook-and-loop component to the tear strip occurs as one of the in-line operational steps of the turn-up operation. Alternatively, the fastener transfer press may be provided as an apparatus separate from the tear strip feed system, such that the tear strips must be transferred to the tear strip feed assembly after the hook-and-loop components have been affixed to the tear strips.

In a sense, the invention is a fastener transfer press apparatus for the affixation of a hook-and-loop fastener component to a tear strip of a paper web turn-up system, the apparatus comprising: a feed roller, a transfer roller and a reciprocating press roller; said transfer roller comprising a fastener transfer surface consisting of a hook-and-loop fastener component, said hook-and-loop fastener component consisting of either a hook component or a loop component of a hook-and-loop fastener; said feed roller and said transfer roller being positioned adjacent each other to receive therebetween a fastener feed tape, said feed tape comprising a release liner and a tear strip hook-and-loop fastener component having an adhesive layer, said tear strip hook-and-loop fastener component adhesively mounted onto said release layer and capable of mating with said fastener transfer surface hook-and-loop fastener component; whereby upon passage of said fastener feed tape between said feed roller and said transfer roller, said tear strip hook-and-loop fastener component mates with said transfer roll fastener transfer surface and is removed from said release liner and positioned between said transfer roller and said reciprocating press roller; said transfer roller and said reciprocating press roller being positioned adjacent each other to receive therebetween the free end of a tear strip and said tear strip hook-and-loop fastener component, said reciprocating roller able to be advanced toward and retracted from said transfer roller; whereby said reciprocating press roller is advanced toward said transfer roller to compress said tear strip and said tear strip hook-and-loop fastener component whereby upon removal of said tear strip said tear strip hook-and-loop fastener component is removed from said transfer roll fastener transfer surface and is adhesively bonded by said adhesive layer to said tear strip.

In another sense, the invention is a fastener transfer press apparatus for the affixation of a hook-and-loop fastener component to a tear strip of a paper web turn-up system, the apparatus comprising: a feed roller, a transfer roller and a reciprocating press roller, wherein said transfer roller is positioned between said feed roller and said reciprocating press roller; said transfer roller comprising a fastener transfer surface consisting of a hook-and-loop fastener component, said hook-and-loop fastener component consisting of either a hook component or a loop component of a hook-and-loop fastener; said feed roller and said transfer roller being positioned adjacent each other to receive therebetween a fastener feed tape, said feed tape comprising a release liner and a tear strip hook-and-loop fastener component having an adhesive layer, said tear strip hook-and-loop fastener component being adhesively mounted onto said release layer and capable of mating with said fastener transfer surface hook-and-loop fastener component; said transfer roller and said reciprocating press roller being positioned adjacent each other to receive therebetween the free end of a tear strip and said tear strip hook-and-loop fastener component, said reciprocating roller able to be advanced toward and retracted from said transfer roller, whereby with said reciprocating roller retracted from said transfer roller said tear strip may be advanced between said transfer roller and said reciprocating press roller; whereby upon rotation of said feed roller and said transfer roller said fastener feed tape passes between said feed roller and said transfer roller such that said tear strip hook-and-loop fastener component contacts said transfer roll fastener transfer surface and is removed from said release liner and rotated into contact with said tear strip between said transfer roller and said reciprocating roller; whereby with said reciprocating press roller advanced toward said transfer roller said tear strip and said tear strip hook-and-loop fastener component are compressed whereby upon retraction of said tear strip from between said transfer roller and said reciprocating press roller said tear strip hook-and-loop fastener component is removed from said transfer roll fastener transfer surface and is adhesively bonded by said adhesive layer to said tear strip.

In still another sense, the invention is a method of affixing a hook-and-loop fastener component to a tear strip of a paper web turn-up system, the method comprising: providing a fastener transfer press comprising a feed roller, a transfer roller and a reciprocating press roller, wherein said transfer roller is positioned between said feed roller and said reciprocating press roller; said transfer roller comprising a fastener transfer surface consisting of a hook-and-loop fastener component, said hook-and-loop fastener component consisting of either a hook component or a loop component of a hook-and-loop fastener; said feed roller and said transfer roller being positioned adjacent each other to receive therebetween a fastener feed tape, said feed tape comprising a release liner and a tear strip hook-and-loop fastener component having an adhesive layer, said tear strip hook-and-loop fastener component being adhesively mounted onto said release layer and capable of mating with said fastener transfer surface hook-and-loop fastener component; said transfer roller and said reciprocating press roller being positioned adjacent each other to receive therebetween the free end of a tear strip and said tear strip hook-and-loop fastener component, said reciprocating roller able to be advanced toward and retracted from said transfer roller, whereby with said reciprocating roller retracted from said transfer roller said tear strip may be advanced between said transfer roller and said reciprocating press roller; whereby upon rotation of said feed roller and said transfer roller said fastener feed tape passes between said feed roller and said transfer roller such that said tear strip hook-and-loop fastener component contacts said transfer roll fastener transfer surface and is removed from said release liner and rotated into contact with said tear strip between said transfer roller and said reciprocating roller; whereby with said reciprocating press roller advanced toward said transfer roller said tear strip and said tear strip hook-and-loop fastener component are compressed whereby upon retraction of said tear strip from between said transfer roller and said reciprocating press roller said tear strip hook-and-loop fastener component is removed from said transfer roll fastener transfer surface and is adhesively bonded by said adhesive layer to said tear strip;

retracting said reciprocating press roller from said transfer roller; advancing said free end of said tear strip between said reciprocating press roller and said transfer roller; positioning said feed tape between said feed roller and said transfer roller; rotating said feed roller, said transfer roller and said reciprocating press roller to remove said tear strip hook-and-loop fastener component from said release liner of said feed tape and to deliver said tear strip hook-and-loop fastener component on said transfer roll to contact said tear strip between said transfer roll and said reciprocating press roll; advancing said reciprocating press roll toward said transfer roll to compress said tear strip hook-and-loop fastener component and said tear strip; continuing rotation of said feed roll, said transfer roll and said reciprocating press roll and retracting said free end of said tear strip from between said transfer roll and said reciprocating press roll and thereby affixing said tear strip hook-and-loop fastener component to said free end of said tear strip.

DETAILED DESCRIPTION OF THE INVENTION

Figure 1:
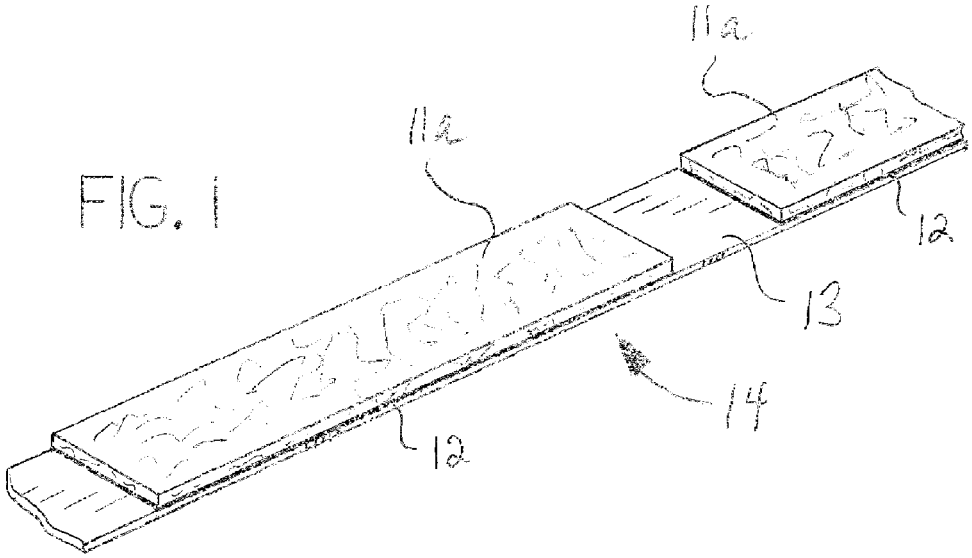
FIG. 1 is a perspective view of a portion of the fastener feed tape showing multiple hook-and-loop fastener components mounted onto the release liner.

With reference to the drawings, the invention will now be described in detail with regard for the best mode and the preferred embodiments.

In general the invention is an apparatus and method for forming a tear strip 10 for use in a turn-up system comprising a slotted guide track 35 having the tear strip 10 retained in a manner which allows the tear strip 10 to be pulled from the slotted guide track 35 in order to cut and secure a spooling paper web 32, the free or forward end 15 of the tear strip 10 comprising a first component 11*a* of a hook-and-loop fastener, such as sold under the brand name VELCRO, the second and mating component 11*b* of the hook-and-loop fastener being mounted onto the rotating member 33 of the spooling system. The term "hook-and-loop fastener" refers to the commonly known fastener system that comprises a hook component having a plurality of hook members mounted onto to a flexible backing member, the backing member having an adhesive layer 12 situated on the opposite side, and a loop component having a plurality of loops or pile members mounted onto a separate flexible backing member, the backing member having an adhesive layer 12 situated on the opposite side. When the hook members of the hook component and the loop members of the loop component are brought into contact a mechanical interlocking occurs that connects the two backing members. Upon a desired length of paper web 32 being wound onto the rotating member 33 to form a roll 31, the end 15 of the tear strip 10 is advanced against the rotating member 33 such that the first 11*a* and second 11*b* components of the hook-and-loop fastener mate, causing the tear strip 10 to wind around the rotating member 33 and be pulled from the slot 36 of the guide track 35, thereby cutting the moving paper web 32 and securing the roll 31 of paper web against unspooling.

A typical turn-up system is disclosed for example in U.S. Pat. No. 5,954,290 to Rodriguez et al., the disclosure of which are incorporated herein by reference, and comprises a rotating member 33, such as a rod, shaft, axle, journal or the like upon which an extended length of paper web 32 is wound at high speed to form a winding, spool or roll 31. Once the desired quantity of paper web 32 is wound onto the rotating member 33 to form roll 31, an elongated, strong, tear strip 10, composed of a paperband, tape, strip, strap, band or similar member of various possible materials of construction, is rapidly drawn against the paper web 32 and onto the paper roll 31, thereby cutting the paper web 32 and securing the end of the paper roll 31 against unspooling. The tear strip 10 is retained within a slotted guide track 35, the slot 36 extending the at least majority length of the guide track 35 and sized such that the tear strip 10 is retained within the guide track 35 when the tear strip 10 is advanced longitudinally, the slot 36 being slightly smaller in width than the width of the tear strip 10 but of sufficient width such that the tear strip 10 can be pulled from the guide track 35 laterally through the slot 36 to cut the moving paper web 32 and be secured against the paper roll 31. Actuation of the tear strip 10 cutting and securing operation is accomplished by advancing the free end 15 of the tear strip 10 from the end of the guide track 35 such that it becomes wound onto the rotating member 33. Such systems are known in the art.

Figure 4:
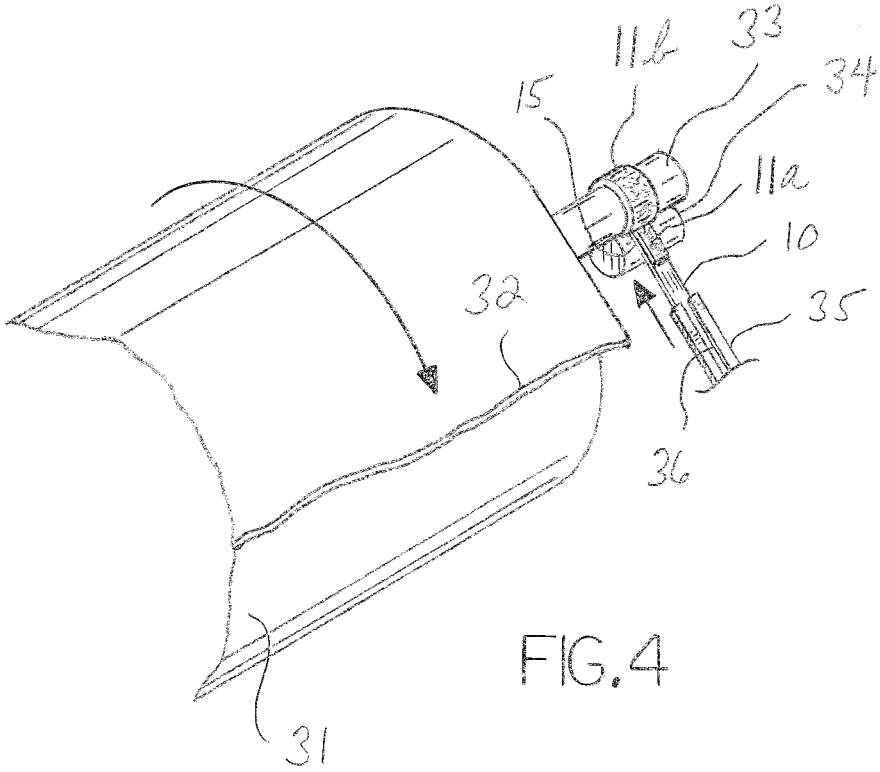
FIG. 4 is a partial illustration of a turn-up system illustrating the free end of the tear strip being advanced onto the hook-and-loop component mounted on the rotating member immediately prior to the tear strip being pulled from the guide track to cut and secure the paper web roll.

As shown in FIG. 4, a short segment of a first hook-and-loop fastener component 11*a* is attached to the free end 15 of the tear strip 10, such as by gluing, bonding, stitching or the like. The first hook-and-loop fastener component 11*a* may be either the hook-bearing element or the loop-bearing element. The second hook-and-loop fastener component 11*b* is secured to the rotating member 33 in suitable manner, such as by adhesive, bonding, mechanical fastening or other mechanisms, and may consist of a short segment, multiple short segments, or preferably an encircling annular segment extending completely around the rotating member 33. The second hook-and-loop fastener component 11*b* will be the properly corresponding mating element for the first hook-and-loop fastener component 11*a*, such that if the first hook-and-loop fastener component 11*a* is the hook element then the second hook-and-loop fastener component will be the loop element, and vice versa. Preferably a nip roller 34 or similar mechanism is mounted adjacent the rotating member 33 at the location of the second hook-and-loop fastener component, the nip roller 34 directing the end 15 of the tear strip 10 and the first hook-and-loop fastener component 11*a* against the rotating member 33 and the second hook-and-loop fastener element. With this structure, when the free end 15 of the tear strip 10 is advanced from the end of the guide track 35, the first and second hook-and-loop fastener components 11*a* and 11*b* mate and the tear strip 10 becomes wound around the rotating member 33. Because the opposite end of the tear strip 10 is restrained in known manner, the winding of the tear strip 10 around the rotating member 33 pulls the tear strip 10 laterally through the slot 36 in the guide track 35, thereby cutting the moving paper web 32 and securing the paper roll 31 from unspooling.

Figure 2:
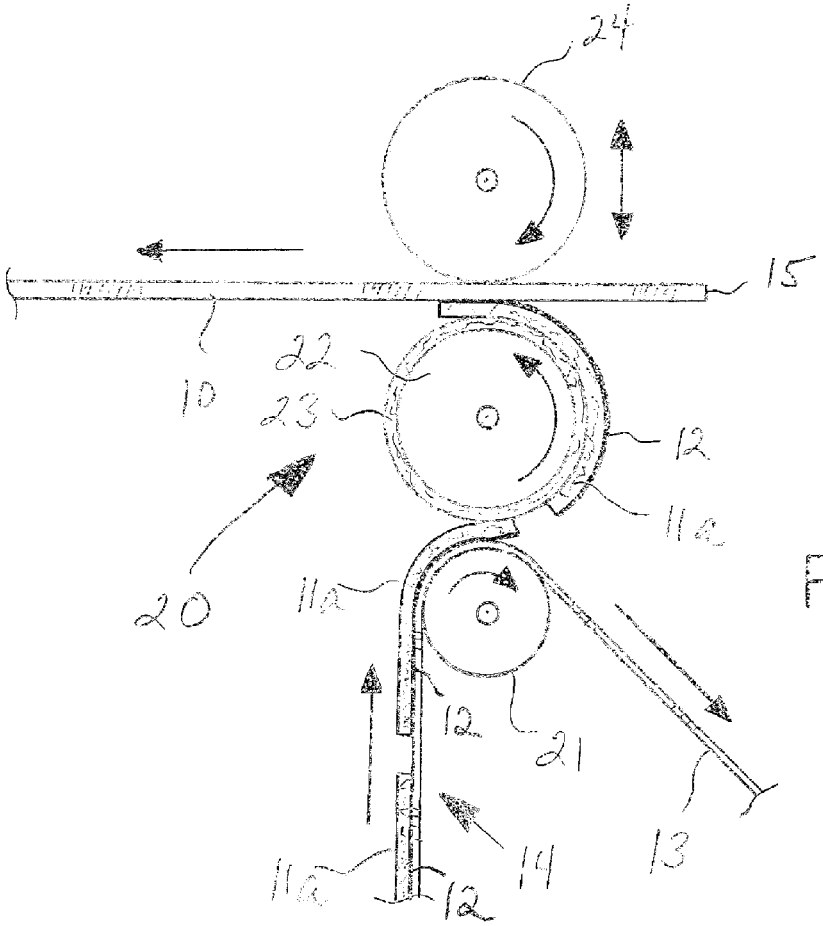
FIG. 2 is a representation of the operating components of the fastener transfer press, shown at the point in the transfer operation when the hook-and-loop component is first being adhered to the tear strip.
Figure 3:
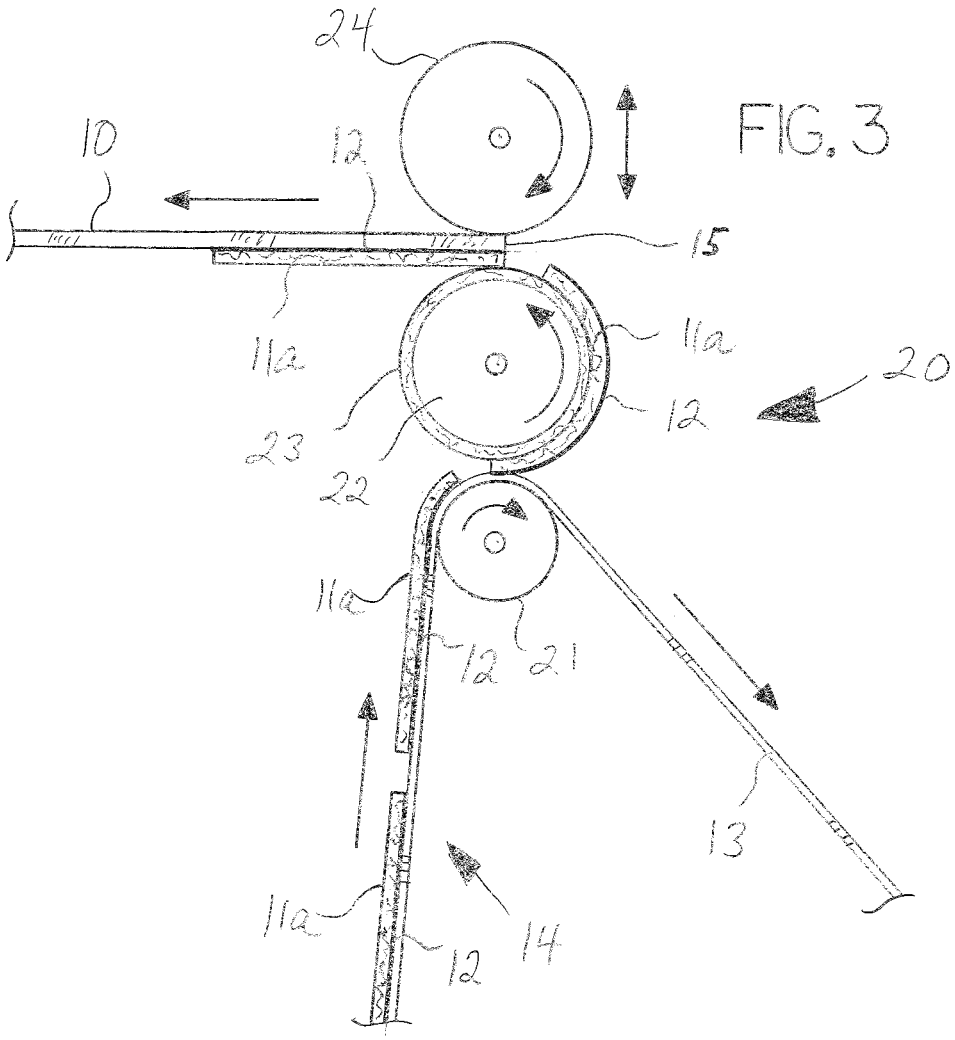
FIG. 3 is a representation of the operating components of the fastener transfer press, shown at the point in the transfer operation when the hook-and-loop component has been fully adhered to the tear strip.

As shown in FIGS. 1 through 3, the apparatus and method for forming the tear strip 10 comprises a fastener transfer press 20 that transfers a hook-and-loop component 11*a*, either the hook component or the loop component of a typical hook-and-loop fastener system, onto the end portion 15 of a tear strip 10, the tear strip 10 then being advanced through a longitudinally slotted guide track assembly 35 such that the hook-and-loop component 11*a* mounted onto the end 15 of the tear strip 10 is brought into contact with the opposite hook-and-loop component 11*b* attached to the rotating member 33 bearing the roll 31, such that the two hook-and-loop components 11*a* and 11*b* mate and cause the tear strip 10 to be pulled laterally through the slot 36 the guide track assembly 35 onto the roll 31.

The hook-and-loop components 11*a* are provided as part of a fastener feeder tape assembly 14, each of the components 11*a* being a short segment comprising either a hook component or loop component and having an adhesive layer 12, the adhesive layer 12 temporarily adhering the hook-and-loop component 11*a* onto an elongated release liner 13. Multiple hook-and-loop components 11*a* are positioned on the release liner 13 and define in combination the fastener feed tape 14, as shown in FIG. 1, which is preferably supplied in roll form.

The fastener transfer press 20 comprises three rollers—a feed roller 21, a fastener transfer roller 22 and a reciprocating press roller 24, as shown in FIGS. 2 and 3. The feed roller 21 and transfer roller 22 are positioned such that the fastener feed tape 14 can be fed between the two rollers 21 and 22, which together define a feed roller pair. The transfer roller 22 is provided with a fastener transfer surface 23 which is formed out of the opposite hook-and-loop component to the tear strip hook-and-loop component 11*a* disposed on the release liner 13. Thus, if the hook-and-loop component 11*a* on the feed tape 14 comprises the hook component of a hook-and-loop fastener system, then the transfer surface 23 will comprise the loop component, and vice-versa. The mechanical interlock strength between the fastener surface layer 23 and the hook-and-loop component 11*a* must greater than the adhesive strength between the adhesive layer 12 and the release liner 13, such that the mechanical interlock between the fastener surface layer 23 and the tear strip hoop-and-loop fastener component 11*a* is sufficient to separate the hook-and-loop component 11*a* from the release liner 13, but the mechanical interlock strength between the fastener surface layer 23 and the hook-and-loop component 11*a* must be less than the adhesive bonding strength of the adhesive layer 12 to the tear strip 10, such that the hook-and-loop component 11*a* will release from the transfer surface 23 of the transfer roller 22 and adhere to the tear strip 10 as discussed in more detail below. The three rollers 21, 22 and 24 rotate incrementally rather than continuously.

The fastener feed tape 14 is delivered into the feed roller pair comprising the feed roller 21 and transfer roller 22 in known manner. As the feed tape 14 passes between the feed roller pair, the tear strip hook-and-loop component 11*a* temporarily mates with the fastener transfer surface 23 on transfer roller 22 and is separated from the release liner 13, thereby exposing the adhesive layer 12. The free end portion 15 of the tear strip 10 is then advanced in known manner between the press roller pair comprising the transfer roller 22 and the reciprocating press roller 24, the reciprocating press roller 24 being retracted to allow unimpeded passage of the end portion 15 of the tear strip 10.

The tear strip hook-and-loop fastener component 11*a* retained on the fastener transfer surface 23 of transfer roller 22 is then rotated so as to pass between the fastener transfer roller 22 and the reciprocating press roller 24, the press roller 24 having been advanced toward the transfer roller 22 to apply pressure to the tear strip 10, and the hook-and-loop component 11*a*. The adhesive layer 12 now comes into direct contact with the free end portion 15 of the tear strip 10. The tear strip 10 is now retracted and the rollers 21, 22 and 23 rotate over an arc substantially equivalent to the length of the hook-and-loop fastener component 11*a*. The bond strength of the adhesive layer 12 to the tear strip 10 being greater than the mechanical interlock strength of the hook-and-loop component 11*a* to the fastener transfer surface 23, the hook-and-loop component 11*a* releases from the transfer roller 22 and remains affixed to the end of the tear strip 10. The press roller 24 is then retracted and the tear strip 10 can now be advanced in known manner through the guide track 35 to perform the turn-up operation, the leading end 15 of the tear strip 10 now having the hook-and-loop component 11*a* fastened thereto.

Preferably, the fastener transfer press 20 is incorporated into the tear strip feed system of the turn-up system such that the application of the hook-and-loop component 11*a* to the tear strip 10 occurs as one of the operational steps of the turn-up operation. Alternatively, the fastener transfer press may 20 be provided as a separate component such that the tear strips 10 are first assembled as described and then transferred or delivered to the guide track 35 of the turn-up system.

It is understood that equivalents and substitutions for certain elements set forth above may be obvious to those of skill in the art, and therefore the true scope and definition of the invention is to be as set forth in the following claims.

I claim:

1. A fastener transfer press apparatus for the affixation of a hook-and-loop fastener component to a tear strip of a paper web turn-up system, the apparatus comprising:

a feed roller, a transfer roller and a reciprocating press roller;

said transfer roller comprising a fastener transfer surface consisting of a hook-and-loop fastener component, said hook-and-loop fastener component consisting of either a hook component or a loop component of a hook-and-loop fastener;

said feed roller and said transfer roller being positioned adjacent each other to receive therebetween a fastener feed tape, said feed tape comprising a release liner and a tear strip hook-and-loop fastener component having an adhesive layer, said tear strip hook-and-loop fastener component adhesively mounted onto said release layer and capable of mating with said fastener transfer surface hook-and-loop fastener component;

whereby upon passage of said fastener feed tape between said feed roller and said transfer roller, said tear strip hook-and-loop fastener component mates with said transfer roll fastener transfer surface and is removed from said release liner and positioned between said transfer roller and said reciprocating press roller;

said transfer roller and said reciprocating press roller being positioned adjacent each other to receive therebetween the free end of a tear strip and said tear strip hook-and-loop fastener component, said reciprocating roller able to be advanced toward and retracted from said transfer roller;

whereby said reciprocating press roller is advanced toward said transfer roller to compress said tear strip and said tear strip hook-and-loop fastener component whereby upon removal of said tear strip said tear strip hook-and-loop fastener component is removed from said transfer roll fastener transfer surface and is adhesively bonded by said adhesive layer to said tear strip.

2. The apparatus of claim 1, wherein said feed roller, said transfer roller and said reciprocating press roller rotate incrementally.

3. The apparatus of claim 1, wherein said free end of said tear strip is advanced between said transfer roller and said reciprocating press roller when said reciprocating press roller is retracted from said transfer roller, and wherein said free end of said tear strip is retracted from between said transfer roller and said reciprocating press roller when said reciprocating press roller is advanced toward said transfer roller.

4. The apparatus of claim 1, wherein said feed roller, said transfer roller and said reciprocating press roller rotate simultaneously.

5. The apparatus of claim 1, wherein said feed roller, said transfer roller and said reciprocating press roller rotate simultaneously when said tear strip is retracted from between said transfer roll and said reciprocating press roller.

6. The apparatus of claim 1, wherein the composition of said adhesive layer is chosen such that the adhesive strength between said adhesive layer and said release liner is less than the mechanical interlocking strength between said tear strip hook-and-loop fastener component and said transfer roll fastener transfer surface, and further such that the adhesive strength between said adhesive layer and said tear strip is greater than the mechanical interlocking strength between said tear strip hook-and-loop fastener component and said transfer roll fastener transfer surface.

7. A fastener transfer press apparatus for the affixation of a hook-and-loop fastener component to a tear strip of a paper web turn-up system, the apparatus comprising:

a feed roller, a transfer roller and a reciprocating press roller, wherein said transfer roller is positioned between said feed roller and said reciprocating press roller;

said transfer roller comprising a fastener transfer surface consisting of a hook-and-loop fastener component, said hook-and-loop fastener component consisting of either a hook component or a loop component of a hook-and-loop fastener;

said feed roller and said transfer roller being positioned adjacent each other to receive therebetween a fastener feed tape, said feed tape comprising a release liner and a tear strip hook-and-loop fastener component having an adhesive layer, said tear strip hook-and-loop fastener component being adhesively mounted onto said release layer and capable of mating with said fastener transfer surface hook-and-loop fastener component;

said transfer roller and said reciprocating press roller being positioned adjacent each other to receive therebetween the free end of a tear strip and said tear strip hook-and-loop fastener component, said reciprocating roller able to be advanced toward and retracted from said transfer roller, whereby with said reciprocating roller retracted from said transfer roller said tear strip may be advanced between said transfer roller and said reciprocating press roller;

whereby upon rotation of said feed roller and said transfer roller said fastener feed tape passes between said feed roller and said transfer roller such that said tear strip hook-and-loop fastener component contacts said transfer roll fastener transfer surface and is removed from said release liner and rotated into contact with said tear strip between said transfer roller and said reciprocating roller;

whereby with said reciprocating press roller advanced toward said transfer roller said tear strip and said tear strip hook-and-loop fastener component are compressed whereby upon retraction of said tear strip from between said transfer roller and said reciprocating press roller said tear strip hook-and-loop fastener component is removed from said transfer roll fastener transfer surface and is adhesively bonded by said adhesive layer to said tear strip.

8. The apparatus of claim 7, wherein said feed roller, said transfer roller and said reciprocating press roller rotate incrementally.

9. The apparatus of claim 7, wherein said feed roller, said transfer roller and said reciprocating press roller rotate simultaneously.

10. The apparatus of claim 7, wherein said feed roller, said transfer roller and said reciprocating press roller rotate simultaneously when said tear strip is retracted from between said transfer roll and said reciprocating press roller.

11. The apparatus of claim 7, wherein said adhesive layer is characterized in that the adhesive strength between said adhesive layer and said release liner is less than the mechanical interlocking strength between said tear strip hook-and-loop fastener component and said transfer roll fastener transfer surface, and further such that the adhesive strength between said adhesive layer and said tear strip is greater than the mechanical interlocking strength between said tear strip hook-and-loop fastener component and said transfer roll fastener transfer surface.

12. A method of affixing a hook-and-loop fastener component to a tear strip of a paper web turn-up system, the method comprising:

providing a fastener transfer press comprising a feed roller, a transfer roller and a reciprocating press roller, wherein said transfer roller is positioned between said feed roller and said reciprocating press roller; said transfer roller comprising a fastener transfer surface consisting of a hook-and-loop fastener component, said hook-and-loop fastener component consisting of either a hook component or a loop component of a hook-and-loop fastener; said feed roller and said transfer roller being positioned adjacent each other to receive therebetween a fastener feed tape, said feed tape comprising a release liner and a tear strip hook-and-loop fastener component having an adhesive layer, said tear strip hook-and-loop fastener component being adhesively mounted onto said release layer and capable of mating with said fastener transfer surface hook-and-loop fastener component; said transfer roller and said reciprocating press roller being positioned adjacent each other to receive therebetween the free end of a tear strip and said tear strip hook-and-loop fastener component, said reciprocating roller able to be advanced toward and retracted from said transfer roller, whereby with said reciprocating roller retracted from said transfer roller said tear strip may be advanced between said transfer roller and said reciprocating press roller; whereby upon rotation of said feed roller and said transfer roller said fastener feed tape passes between said feed roller and said transfer roller such that said tear strip hook-and-loop fastener component contacts said transfer roll fastener transfer surface and is removed from said release liner and rotated into contact with said tear strip between said transfer roller and said reciprocating roller; whereby with said reciprocating press roller advanced toward said transfer roller said tear strip and said tear strip hook-and-loop fastener component are compressed whereby upon retraction of said tear strip from between said transfer roller and said reciprocating press roller said tear strip hook-and-loop fastener component is removed from said transfer roll fastener transfer surface and is adhesively bonded by said adhesive layer to said tear strip;

retracting said reciprocating press roller from said transfer roller;

advancing said free end of said tear strip between said reciprocating press roller and said transfer roller;

positioning said feed tape between said feed roller and said transfer roller;

rotating said feed roller, said transfer roller and said reciprocating press roller to remove said tear strip hook-and-loop fastener component from said release liner of said feed tape and to deliver said tear strip hook-and-loop fastener component on said transfer roll to contact said tear strip between said transfer roll and said reciprocating press roll;

advancing said reciprocating press roll toward said transfer roll to compress said tear strip hook-and-loop fastener component and said tear strip;

continuing rotation of said feed roll, said transfer roll and said reciprocating press roll and retracting said free end of said tear strip from between said transfer roll and said reciprocating press roll and thereby affixing said tear strip hook-and-loop fastener component to said free end of said tear strip.

13. The method of claim 12, wherein said feed roller, said transfer roller and said reciprocating press roller are rotates incrementally.

* * * * *